US008713868B2

(12) United States Patent
Kadzban

(10) Patent No.: US 8,713,868 B2
(45) Date of Patent: May 6, 2014

(54) STACKABLE OFFICE PANELS

(71) Applicant: Ronald J. Kadzban, Grandville, MI (US)

(72) Inventor: Ronald J. Kadzban, Grandville, MI (US)

(73) Assignee: Compatico Inc., Grand Rapids, MI (US)

( * ) Notice: Subject to any disclaimer, the term of this patent is extended or adjusted under 35 U.S.C. 154(b) by 0 days.

(21) Appl. No.: 13/713,875

(22) Filed: Dec. 13, 2012

(65) Prior Publication Data

US 2013/0097958 A1 Apr. 25, 2013

Related U.S. Application Data

(63) Continuation of application No. 12/774,187, filed on May 5, 2010, now abandoned.

(51) Int. Cl.
*E04C 2/34* (2006.01)

(52) U.S. Cl.
USPC ..... 52/239; 52/36.1; 52/481.2

(58) Field of Classification Search
USPC ..... 52/36.1, 238.1, 239, 481.2, 578; 160/135
See application file for complete search history.

(56) References Cited

U.S. PATENT DOCUMENTS 5,058,347 A * 10/1991 Schuelke et al. ..... 52/239
5,347,778 A * 9/1994 Bray ..... 52/239
6,389,773 B1 * 5/2002 Reuter et al. ..... 52/582.2
6,393,783 B2 * 5/2002 Emaus et al. ..... 52/239
6,729,085 B2 * 5/2004 Newhouse et al. ..... 52/239
6,964,138 B2 * 11/2005 Carroll et al. ..... 52/239
8,046,957 B2 * 11/2011 Towersey et al. ..... 52/79.9

OTHER PUBLICATIONS

Avenir Specification Guide, Jan. 2010.

* cited by examiner

*Primary Examiner* — Brian Glessner
*Assistant Examiner* — James Buckle, Jr.
(74) *Attorney, Agent, or Firm* — Mitchell Intellectual Property Law, PLLC

(57) ABSTRACT

An upper stackable panel is provided for use with lower panels having a structural panel to panel, connector mount located at least at each upper corner of said lower panel, to which a panel to panel connector can be secured by at least one fastener. The upper panels have a structural panel mounting member located at least at each bottom corner, at a location adjacent an upper corner panel to panel connector mount when the upper panel is positioned on top of the lower panel. Each lower corner panel mounting member has a fastener configuration which is compatible with that of the adjacent upper corner panel to panel connector mount on the lower panel. At least one fastener secures each said bottom corner panel mounting member to its adjacent upper corner panel to panel connector mount, to create a structural connection between the upper and lower panels at each of their respective lower and upper corners.

19 Claims, 9 Drawing Sheets

STACKABLE OFFICE PANELS

STACKABLE OFFICE PANELS

This is a continuation of application Ser. No. 12/774,187, filed May 5, 2010.

FIELD OF THE INVENTION

The present invention relates to the field of office panel systems.

BACKGROUND

Office panel systems comprise a plurality of panels which can be gauged together in a side-by-side manner to define an individual workspace. Typically, cabinets and work surfaces can be hung on the panels.

Some panel systems include stackable upper panels, which can be placed on top of lower panels. In one system, the stackable upper panel includes downwardly projecting prongs which extend into openings in the panels below. The openings in the lower panel become accessible when the removable top cap on the lower panel is removed.

Yet another system secures the upper panels to the lower panels by removing the end caps on the lower panels, and removing and replacing the structural slotted end splines on the panels with taller end splines which project above the level of the original panel. The top cap on the lower panel is removed, and the upper panel is then positioned on the top of the lower panel and secured between the upwardly extending structural splines. Once the stack is assembled, the removed end caps are placed over the exposed portions of the structural splines on the lower panels and additional end caps are placed over the portions of the structural splines which extend upwardly and secure the stacked upper panel in place.

Yet another system employs L-shaped mounting brackets which can be bolted onto the tops of the lower panels at each upper end corner. The upper stackable panel is positioned on top of the lower panel and secured at its ends to the upstanding legs of the L-shaped brackets. End caps are then placed over the ends of the upper panels.

SUMMARY OF THE INVENTION

The present invention is a stackable upper panel and panel system. An upper stackable panel is provided for use with lower panels having a structural panel to panel connector mount located at least at each upper corner of said lower panel, to which a panel to panel connector can be secured by at least one fastener. The upper panels have a structural panel mounting member located at least at each bottom corner, at a location adjacent an upper corner panel to panel connector mount when the upper panel is positioned on top of the lower panel. Each said lower corner panel mounting member has a fastener configuration which is compatible with that of the adjacent upper corner panel to panel connector mount on the lower panel. At least one fastener secures each said bottom corner panel mounting member to Its adjacent upper corner panel to panel connector mount, to create a structural connection between the upper and lower panels at each of their respective lower and upper corners.

DESCRIPTION OF THE PREFERRED EMBODIMENTS

Figure 1:
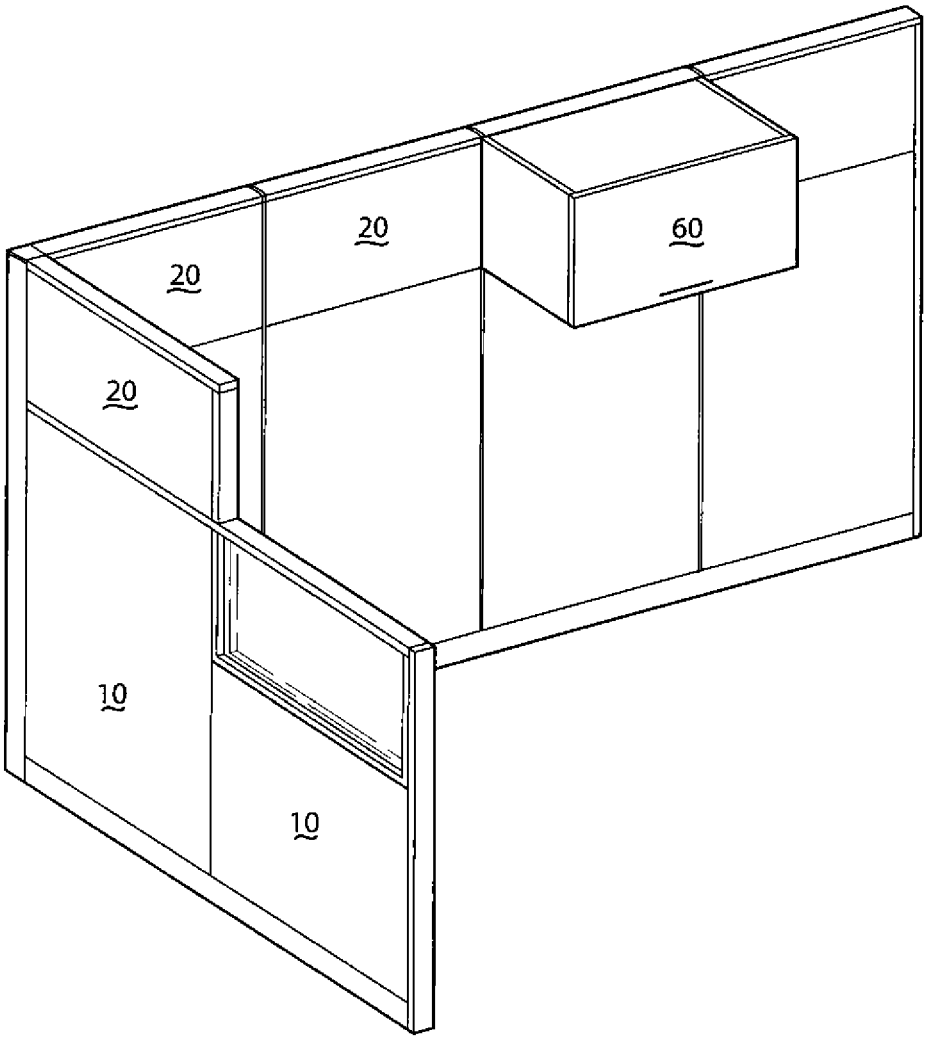
FIG. 1 is a perspective view of stackable upper panels stacked on and secured to lower panels arranged in an office workstation configuration.

In the preferred embodiments, the stackable upper panels 20 can he stacked on and secured to a plurality of lower panels 10 (FIG. 1). Cabinets 60 and other such items can be hung on the lower cabinets due to the structural connection which is provided between the upper stackable panels 20 and lower panels 10.

Figure 2:
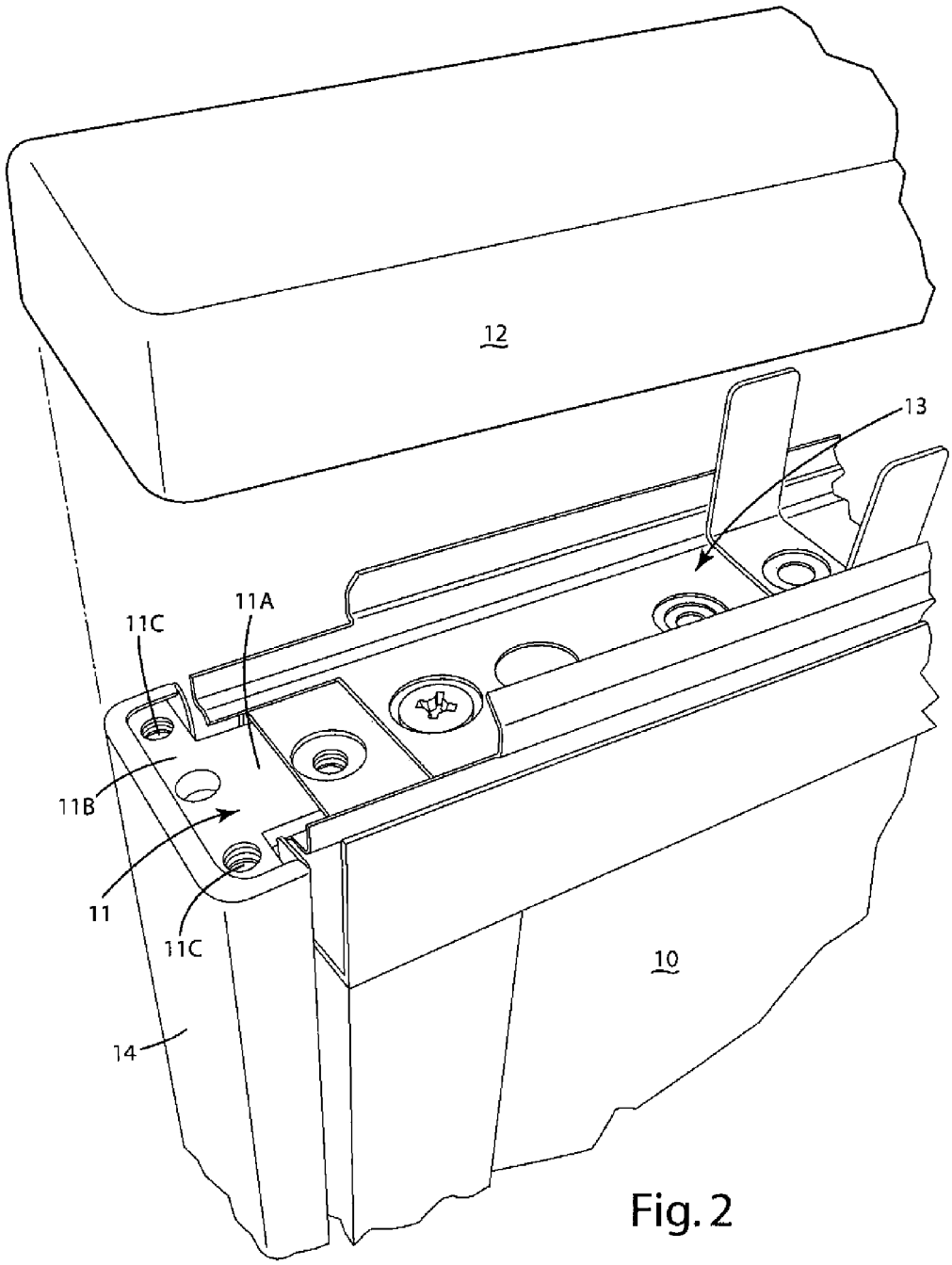
FIG. 2 is a fragmentary perspective view of an upper corner of a lower panel, with the top cap exploded away.
Figure 3:
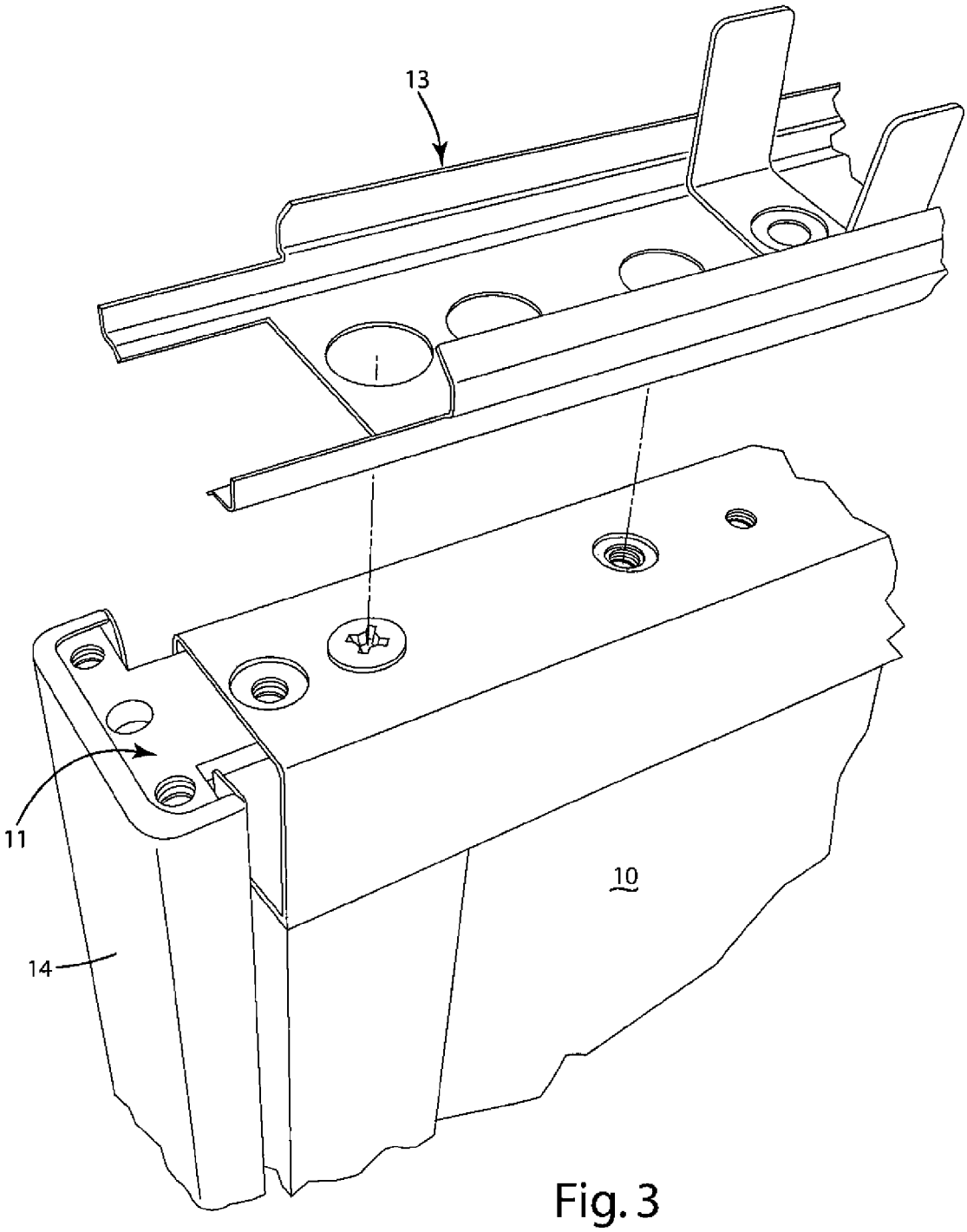
FIG. 3 is the same view as FIG. 2, with the top cap mounting member exploded away.

Lower panels 10 are of a prior art construction and include a removable top cap 12 which is removably secured to the top of panel 10 by means of a top cap mounting member 13 (FIGS. 2 and 3). Removable panel end caps 14 conceal, except for the slots, elongated slotted structural slotted, splines which are secured to the ends of the panel frames. Located at both the upper and lower corners of panel 10 are panel to panel connector mounts 11. Each panel to panel connector mount includes a shank portion 11*a* which is secured to the top or bottom of panel 10. Shank 11*a* terminates in a cross piece 11*b* which includes a pair of spaced threaded apertures 11*c*. The purpose of panel to panel connector mount 11 is to facilitate securance of panel to panel connectors 40 (FIG. 7) to the top and bottom corners of panels 10, so that, adjacent panels can be gauged together as shown in FIG. 1. As can be seen in connectors 40, suitable fasteners 30 pass through holes 40*a* and are threaded into the threaded apertures 11*c* of panel to panel connector mount 11. Panel to panel connector 40 includes an additional pair of holes 40*b* which are used to fasten the connector to the adjacent panel in linear abutting relationship. Holes 40*c* and 40*d* are provided to facilitate attaching an adjacent panel 10 at an angle to the first panel 10.

Figure 4:
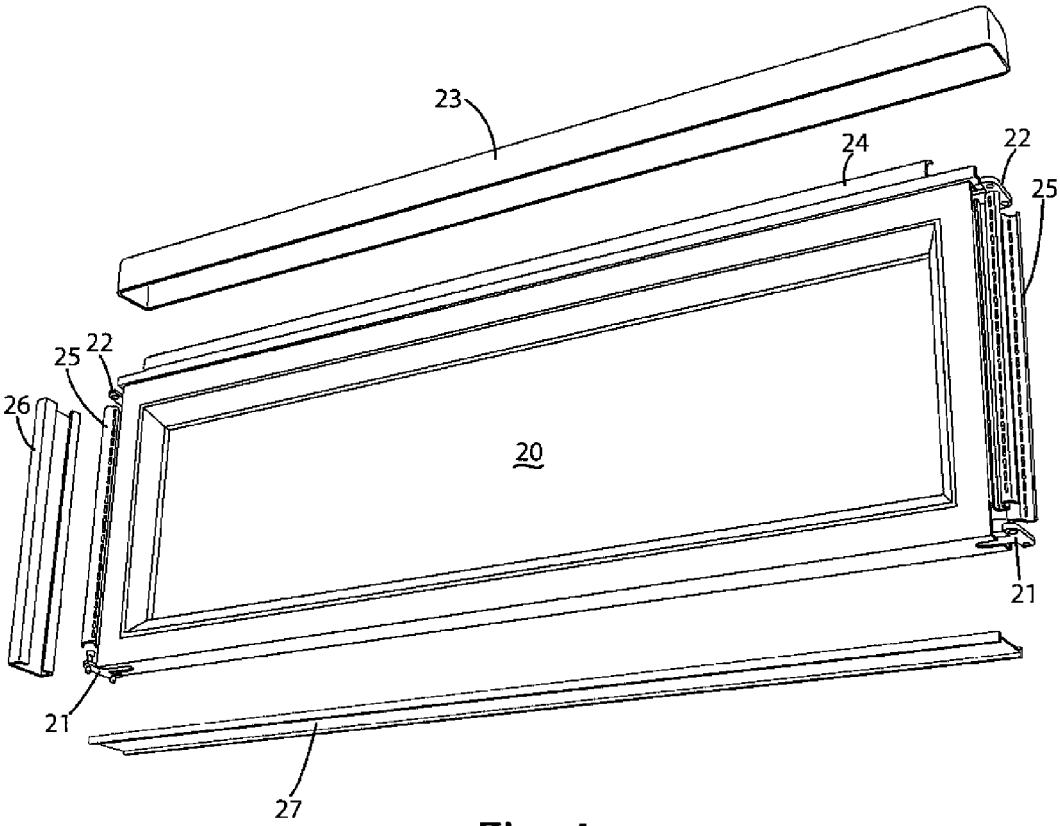
FIG. 4 is a perspective view of a preferred embodiment upper panel member, with its top cap, bottom spacer and left end cap exploded away.
Figure 5:
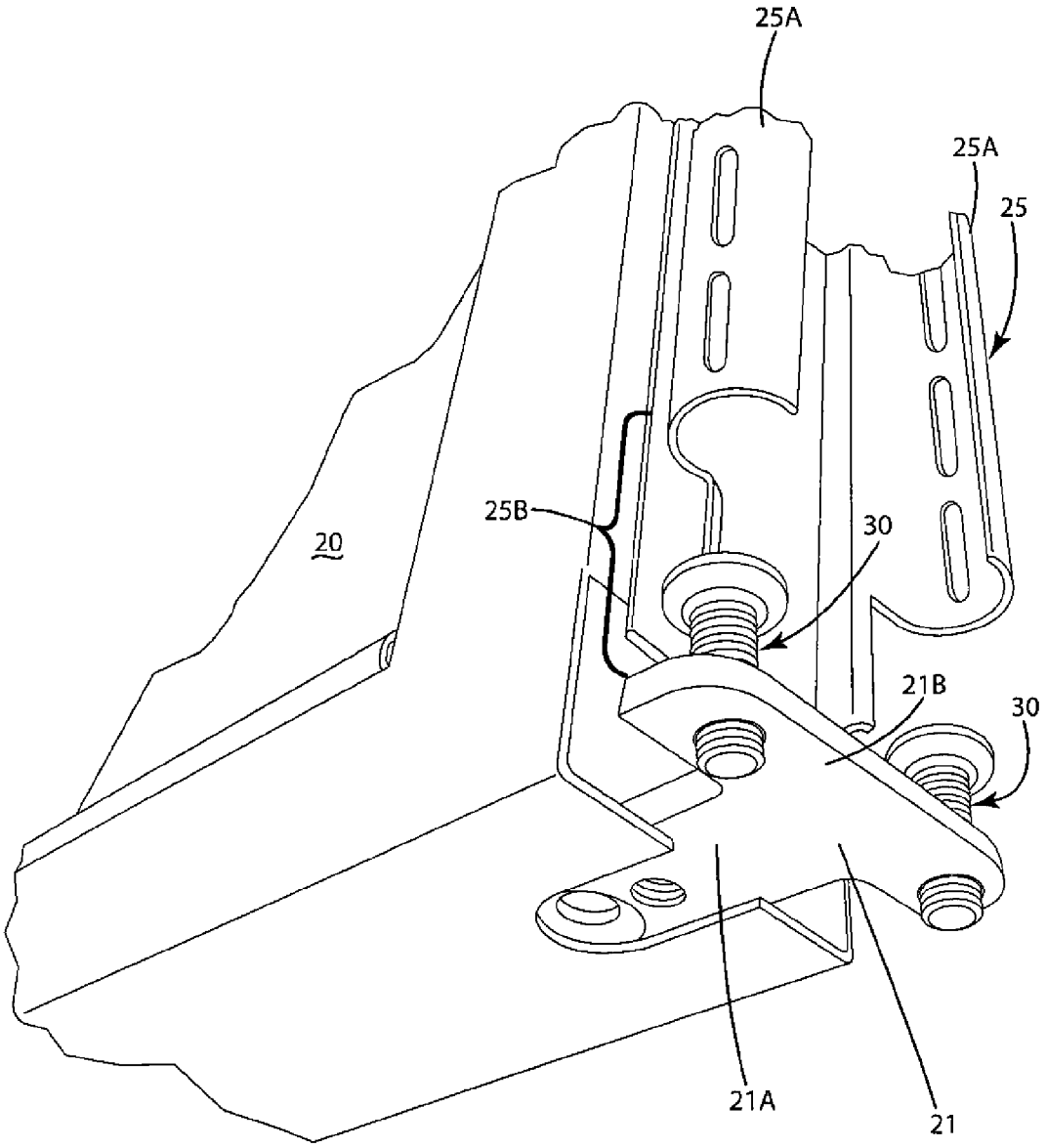
FIG. 5 is a perspective view of a lower corner of an upper panel member.

The upper stackable panel 20 of the preferred embodiment includes a panel mounting member 21 at each lower corner of upper panel 20 (FIGS, 4, 5,6, 7 and 8). Like panel 10, panel 20 includes a removable top cap 23 which is held in position by a top cap mount 24 (FIG. 4). A slotted structural spline 25 is secured to each end of panel 20. Structural splines 25 include slotted flanges 25*a* which extend out from the panel ends, over the panel mounting members 21, for receiving hanger brackets tor hanging cabinets and the like on top panels 20 (see cabinet 60 which is hung on a panel 20 in the assembly of FIG. 1). The slotted flanges 25*a* on each slotted spline 25 terminate a distance 25*b* above mounting member 21 which is sufficient to allow an installer to insert and manipulate fasteners 30 into the openings 21*c* in mounting member 21. An end trim piece 26 is provided to cover structural spline 25, leaving a gap such that the slots in spline 25 are accessible for panel mounting.

A separate elongated decorative insert 27, which is not a component, of upper panel 20, is provided for seating on top of panel 10 after top cap mount 13 is removed. Panel 20 is then seated on top of decorative insert 27. Insert 27 masks the gap between upper panel 20 and lower panel 10.

A panel to panel connector mount 22 is located at each upper corner of upper panel 20. Panel to panel connectors 40 can be secured to connector mounts 22 by two fasteners 30 to facilitate connection of two extended panels at the tops of upper panels 20. Panel to panel connector mounts 22 are substantially identical in configuration to panel connector mounts 11 in leaver panels 10.

Panel mounting members 21 have the same fastener configuration as panel connector mounts 11, and have the same general overall configuration as panel connector mounts 11. Thus, they have a shank 21*a*, a crosspiece 21*b* and a pair of threaded apertures 21*e* (FIGS. 5-8).

Figure 7:
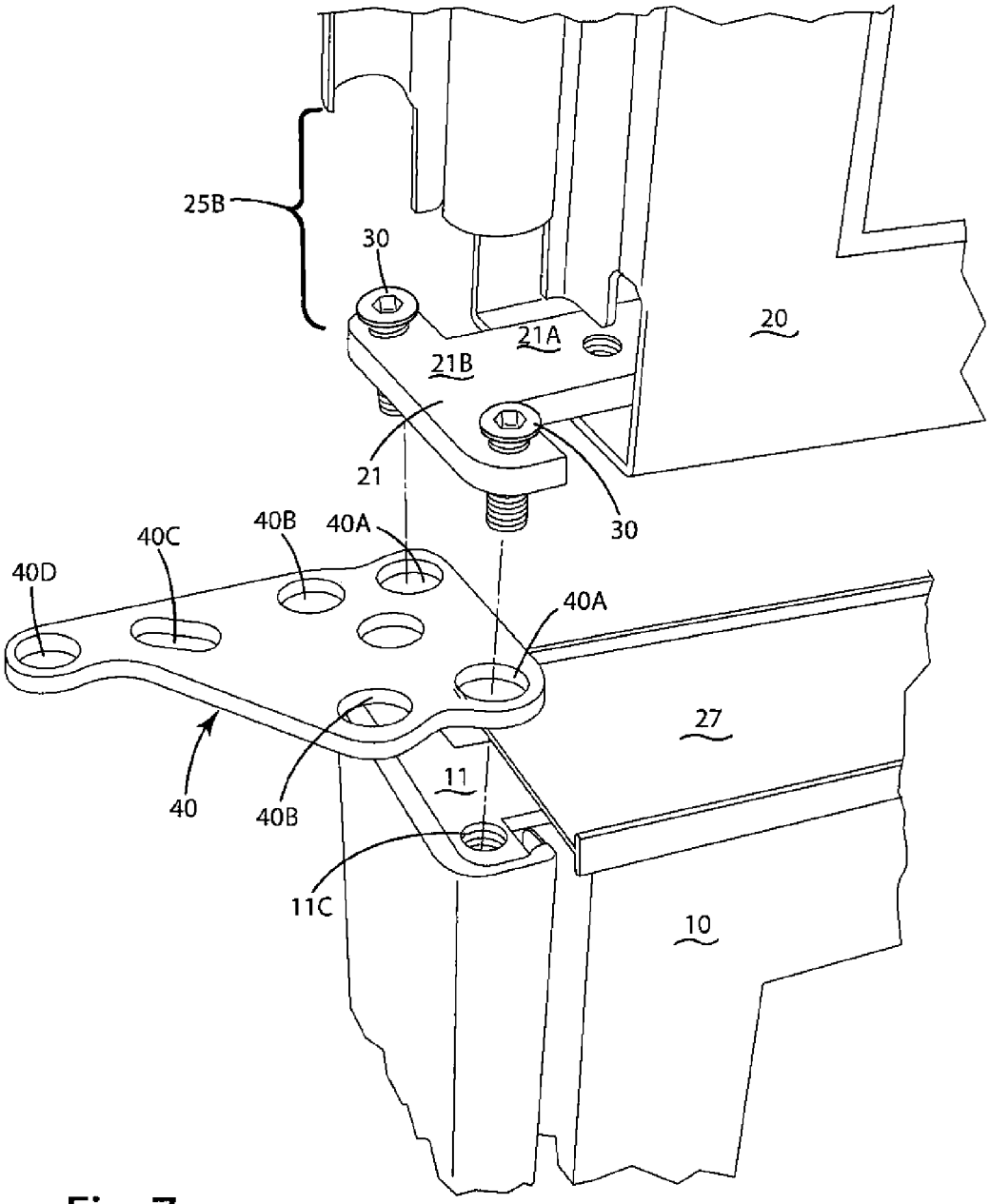
FIG. 7 is a perspective fragmentary view of the upper and lower panels being joined together, with a panel to panel connector located between them at their respective upper arid lower corners.
Figure 8:
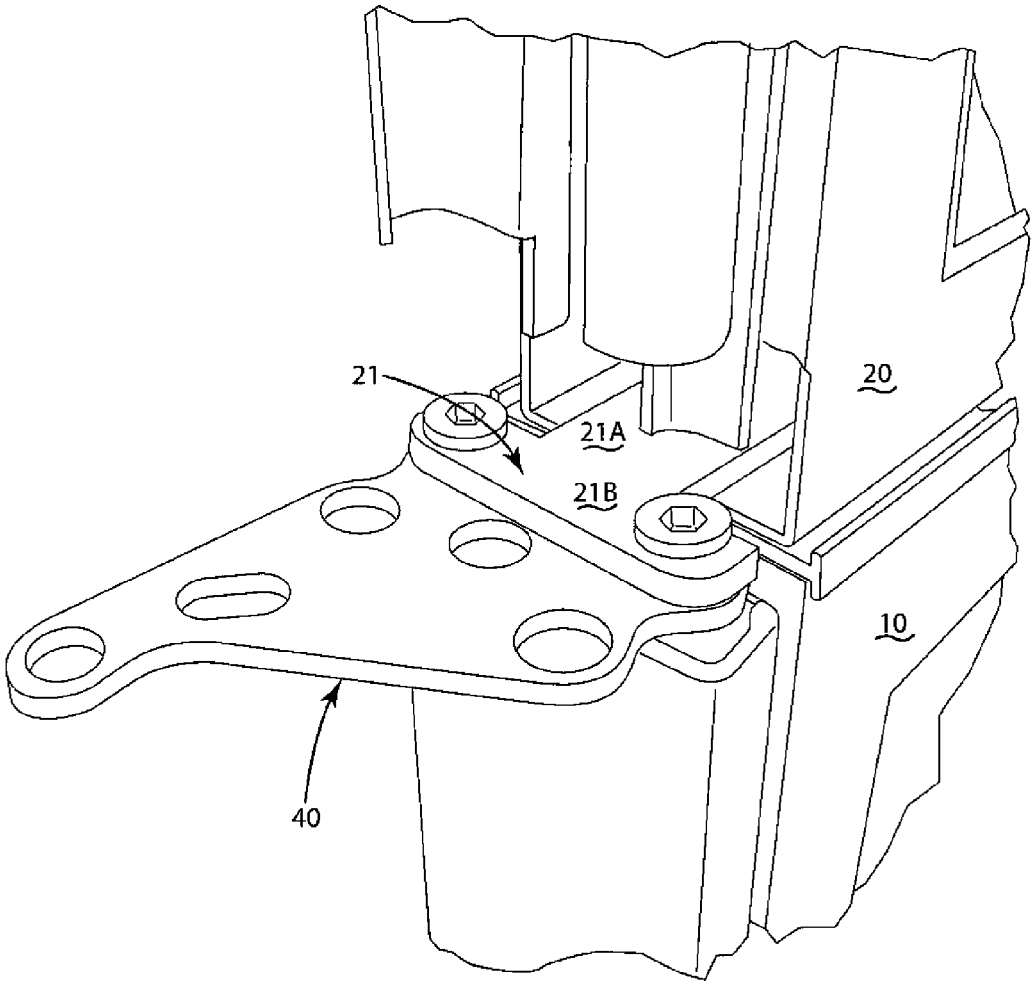
FIG. 8 is a fragmentary perspective view which is similar to that of FIG. 7, but with the tipper and lower panels now secured to each other.

The panel to panel connector mounts 11 and the panel mounting members 21 are structural members. "Structural" refers to the fact that members 11 and 21 are sufficiently strong and sturdy that when secured together by fasteners 30 as shown in FIG. 8, and as shown in progress in FIG. 7, panel 20 is held sufficiently securely and rigidly to panel 10 that cabinets 60 and the like can be mounted on upper panel members 20. In the preferred embodiment, they are made of rigid steel approximately three sixteenths of an inch thick.

Figure 6:
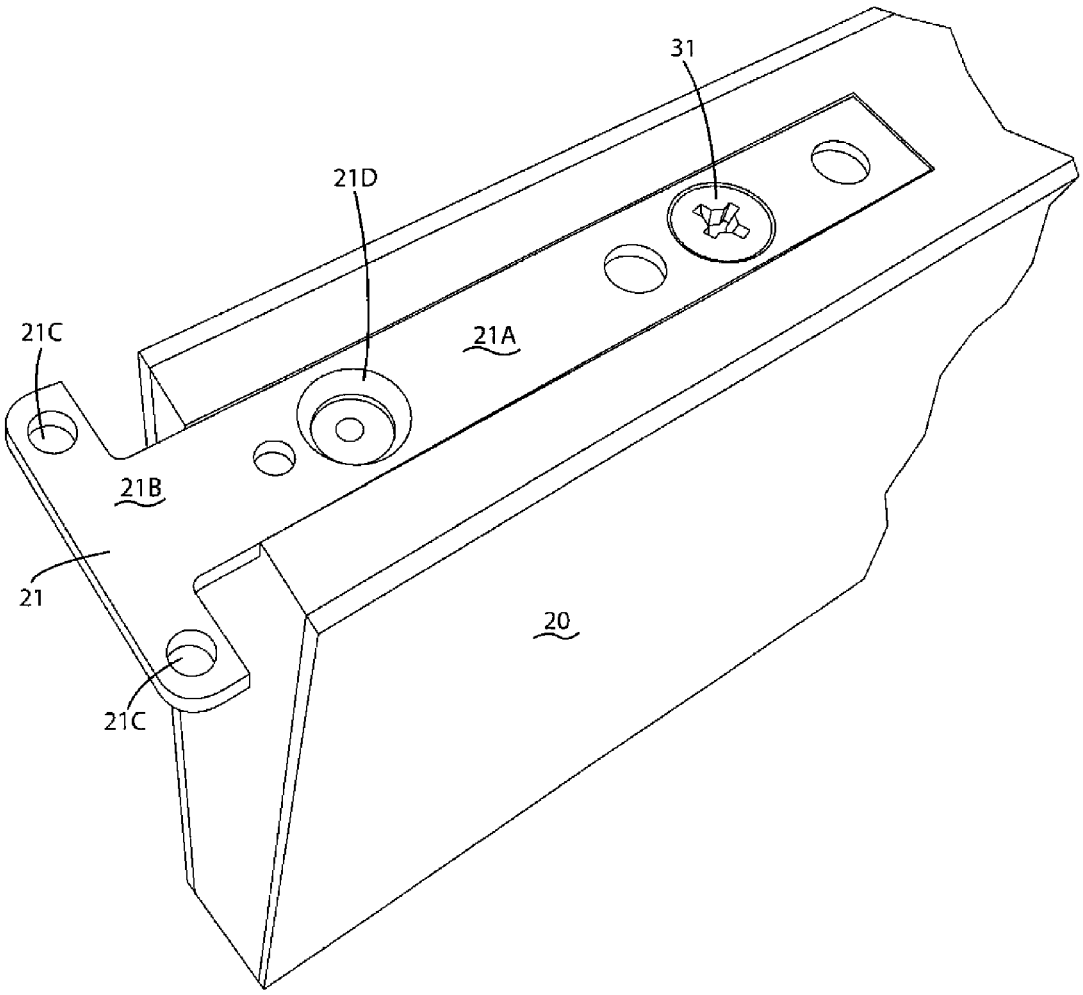
FIG. 6 is a perspective view of the inverted lower corner of an alternative embodiment upper stackable panel.

Panel to panel connectors 40 are also strong, rigid steel members, hut have a thickness of about one-eighth of an inch. In upper panels 20 which are made with a steel frame, panel mounting members 21 are welded to the steel frame of upper panel 20. The panel 20 of FIG. 6 is a particle board core panel. Panel mounting member 21 is positioned within a routed channel and is secured by threaded wood screws 31, positioned in tapered mounting apertures 21*d* (FIG. 6).

Figure 9:
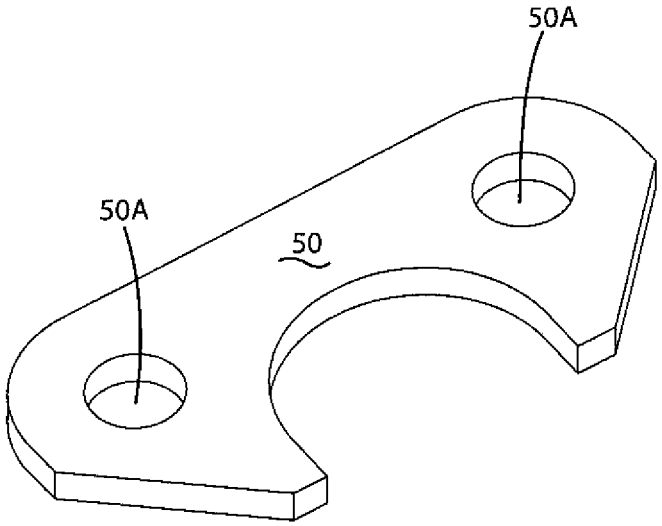
FIG. 9 is a perspective view of a spacer which can be positioned between the upper and lower panel members in place of a panel to panel connector.

To mount an upper panel 20 on top of a lower panel 10, top cap 12 and top cap mounting member 13 are both removed from the top of lower panel 10, as shown in FIGS. 2 and 3. Decorative insert 27 is then placed on top of lower panel 10 (FIG. 7). If there is to be an adjacent panel, panel to panel connector 40 is positioned for mounting on panel to panel connector mount 11 as shown in FIG. 7. Alternatively, the spacer 50 of FIG. 9, having holes 50*a* through which fasteners 30 can be passed, is positioned where panel to panel connector 40 is shown in FIG. 7. Spacer 50 does not extend beyond the ends of the panels 10 and 20.

Upper panel 20, with threaded fasteners 30 started in threaded apertures 21*c*, are then extended through holes 40*a* in connector 40 or through holes 50*a* in spacer 50, and are then threaded into receiving apertures lie in panel to panel connector mount 11 (see FIG. 7). When fasteners 30 are tightened down, the arrangement is as shown in FIG. 8.

Of course it is understood that the above is merely a preferred embodiment of the invention and that various changes and alterations can he made without departing from the spirit and broader aspects thereof.

The invention claimed is:

1. A stackable upper attachable panel for use in a panel system comprising a lower panel having a structural panel to panel connector mount located at least at each upper corner of said lower panel, and a panel to panel connector which can be secured by at least one fastener to said structural panel to panel connector mount, for connecting said lower panel to a horizontally adjacent panel with said panel to panel connector;

a said stackable upper panel comprising: a structural panel mounting member located at least at each bottom corner of said upper panel, at a location adjacent an upper corner panel to panel connector mount when said upper panel is positioned on top of said lower panel, each said structural panel mounting member having a fastener configuration which is compatible with that of said adjacent structural panel to panel connector mount on said lower panel;

at least one fastener secured directly to each said structural panel mounting member of said upper panel for directly securing said structural panel mounting member said structural panel to panel connector mount located at said upper corner of said lower panel, to create a direct structural connection between said upper structural panel mounting member and said structural panel to panel connector on said lower panel, to thereby structurally connect said upper panel to a lower panel;

a slotted spline on each end of the said upper panel, having spaced slotted flanges projecting out above said structural panel projecting out above said structural panel mounting member; said slotted flange terminating a distance above said structural panel mounting member which is sufficient to allow an installer to insert and manipulate said fastener in said structural panel mounting member.

2. The stackable upper panel of claim 1, in which said lower corner panel mounting members of said upper panel are located on said panel such that there is a space between each said lower corner mounting member and said upper corner panel to panel connector mounts of said lower panel when said upper panel is positioned on to of said lower panel, for receiving within said space either the end of a panel to panel connector, or a spacer which does not project beyond the ends of the upper and lower panels.

3. The stackable upper panel of claim 2. in which said lower corner panel mounting members of said upper panel has substantially the same configuration of said upper corner panel to panel connector mounts of said lower panel.

4. The stackable upper panel of claim 3 in which said. lower corner panel mounting members of said upper panel is secured to said upper corner panel to panel connector mounts of said lower and by two spaced fasteners.

5. The stackable upper panel of claim 4, for which a decorative spacer is provided, for positioning between said upper stackable panel and said lower panel.

6. The stackable upper panel of claim 2. for which a decorative spacer is provided, for positioning between said upper stackable panel and said lower panel.

7. The stackable upper panel of claim 1 for which a decorative spacer is provided for positioning between said upper stackable panel and said lower panel.

8. The stackable upper panel of claim 1, in which said lower corner panel mounting members of said upper panel are located on said panel such that there is a space between each said lower corner mounting member and said upper corner panel to panel connector mounts of said lower panel when said upper panel is positioned on top of said lower panel, for receiving within said space either the end of a panel to panel connector, or a spacer which does not project beyond the ends of the upper and lower panels.

9. The stackable upper panel of claim 8, for which a decorative spacer is provided, for positioning between said upper stackable panel and said lower panel.

10. A stackable panel system comprising:

a lower panel having a top edge and a separate structural panel to panel connector mount located on said top edge of each upper corner of said lower panel; a panel to panel connector which can be secured by at least one fastener to said structural panel to panel connector mount, for connecting said lower panel to a horizontally adjacent panel;

a stackable upper panel having a bottom edge and a separate structural panel mounting member located on said bottom edge of each bottom corner of said upper panel, at a location adjacent said structural panel to panel connector mount on said lower panel, when said upper panel is positioned on top of said lower panel, each said structural panel mounting member having a fastener configuration which is compatible with that of said adjacent structural panel to panel connector mount on said lower panel;

at least one fastener directly secured to each said structural panel mounting member of said upper panel and to its adjacent structural panel to panel connector mount of said lower panel to create a direct structural connection between said structural panel mounting member of said upper panel and said panel to panel connector mount of said lower panel, to thereby structurally connect said upper and lower panels at leach of their respective lower and upper corners.

11. A stackable panel system comprising:

a lower panel having a top edge and a separate structural panel to panel connector mount located on said top edge of each upper corner of said lower panel; a panel to panel connector which can be secured by at least one fastener to said structural panel to panel connector mount;

a stackable upper panel having a bottom edge and a separate structural panel mounting member located on said bottom edge of each bottom corner of said upper panel, at a location adjacent said structural panel to panel connector mount on said lower panel, when said upper panel is positioned on top of said lower panel, each said structural panel mounting member having a fastener configuration which is compatible with that of said adjacent structural panel to panel connector mount on said lower panel;

at least one fastener directly securing each said structural panel mounting member of said upper panel to its adjacent structural panel to panel connector mount of said lower panel, to create a direct structural connection between said upper and lower panels at each of their respective lower and upper corners; a corner spacer; said structural panel mounting members of said upper panel are being located on said upper panel such that there is a space between each said structural panel mounting member on said upper panel and said structural panel to panel connector mounts of said lower panel when said upper panel is positioned on top of said lower panel, for receiving within said space either the end of a panel to panel connector, or said corner spacer, said corner spacer being dimensioned to fit within said space such that it does not project beyond the ends of the upper and lower panels.

12. The stackable panel system of claim 11 in which said lower corner panel mounting members of said upper panel has substantially the same configuration of said upper corner panel to panel connector mounts of said lower panel,

13. The stackable panel system of claim 12 in which said lower corner panel mounting members of said upper panel is secured to said upper corner panel to panel connector mounts of said lower panel by two spaced fasteners.

14. The stackable panel system of claim 13, for which a decorative spacer is provided, for positioning between said upper stackable panel and said lower panel.

15. The stackable panel system of claim 11, for which a decorative spacer is provided, for positioning between said upper stackable panel and said lower panel.

16. The stackable panel and system of claim 10, for which a decorative spacer is provided, for positioning between said upper stackable panel and said lower panel.

17. The stackable panel system of claim 10 which includes a slotted spline on each end of the said upper panel, having spaced slotted flanges projecting out above said structural panel mounting member; said slotted flanges terminating a distance above said structural panel mounting member which is sufficient to allow an installer to insert and manipulate said fastener in said structural panel mounting member.

18. The stackable panel system of claim 17, in which said lower corner panel mounting members of said upper panel are located on said panel such that there is a space between each said lower corner mounting member and said upper corner panel to panel connector mounts of said tower panel when said upper panel is positioned on top of said lower panel, for receiving within said space either the end of a panel to panel connector, or a spacer which does not project beyond the ends of the upper and lower panels.

19. The stackable panel system of claim 18, for which a decorative spacer is provided, for positioning between said upper stackable panel and said lower panel.

* * * * *